United States Patent [19]

Logstrup

[11] Patent Number: 5,030,797

[45] Date of Patent: Jul. 9, 1991

[54] FLEXIBLE POWER CURRENT CONDUCTOR

[76] Inventor: Jorgen Logstrup, 29 Ocean Tower, Salthill, Galway, Ireland

[21] Appl. No.: 583,821

[22] Filed: Sep. 17, 1990

[30] Foreign Application Priority Data

Sep. 28, 1989 [DK] Denmark ..... 4794/89

[51] Int. Cl.[5] ..... H01B 7/04; H01R 11/09

[52] U.S. Cl. ..... 174/68.1; 174/129 R; 439/502; 439/507

[58] Field of Search ..... 174/68.1, 129 R, DIG. 8; 238/14.1, 14.11; 439/502, 504, 507, 510, 883, 894, 932

[56] References Cited

U.S. PATENT DOCUMENTS

| | | | |
|---|---|---|---|
| 1,865,718 | 7/1932 | Perl | 238/14.1 |
| 1,938,563 | 12/1933 | Deems | 238/14.1 X |
| 3,212,046 | 10/1965 | Abel et al. | 439/502 |

*Primary Examiner*—Laramie E. Askin

*Attorney, Agent, or Firm*—Merchant & Gould Smith, Edell, Welter & Schmidt

[57] ABSTRACT

A flexible power current conductor (1) comprises a number of thin copper foils and is provided with through-going oblong holes (5) for clamping bolts at each end. The foils are held together in a middle area by means of a thermo-shrinking insulating plastic material which engages incisions (4) and secures the foils in relation to each other.

5 Claims, 1 Drawing Sheet

FLEXIBLE POWER CURRENT CONDUCTOR

The invention relates to a flexible power current conductor comprising a number of thin conducting foils stacked one on top of the other with a uniform width, preferably copper foils. The thin conducting foils have through-holes for clamping bolts. The conducting foils are held together in a middle area by means of an encasing material which encircles a part of the conducting foils. The conducting foils each have at least one point where the width deviates from the width of the rest of the foil. The points of the conducting foils are aligned with each other with the encasing material encircling the point of each conducting foil where the width deviates. The through-holes, located outside the encasing material, are oblong and extend in a longitudinal direction of the conductor.

Conductors of this type are employed for connecting parts to contact rails or the like, when massive conductors or rails cannot be employed. Flexible conductors are usually provided with a hole for a clamping bolt at each end and have layers which are soldered together at the ends. In this way the layers will not be able to become displaced in relation to each other at the holes, but only in the area between the holes.

However, it has become apparent in practice that the known flexible conductors are not sufficiently flexible for a number of assembling tasks, and that there is a need for bending such conductors more than they are intended for.

The object of the invention is to construct a flexible power current conductor which is more flexible than the known conductors without causing other disadvantages.

This is achieved by securing the foils in relation to each other within a certain area, as the power current conductor according to the invention is designed by holding together the conducting foils in a middle area by means of an encasing material which encircles a part of the conducting foils. The conducting foils are also designed to each have at least one point where the width devicates from the width of the rest of the foil. The points of the conducting foils are aligned with each other with the encasing material encircling the point of each conducting foil where the width deviates.

Within the area in which the conducting foils are encased by another material, the foils will not be able to become displaced in relation to each other at the point where there is a deviation in width, as the foils will be "locked" together by the encasing material which grabs at the point of the deviation. However, the foils may become displaced in relation to each other towards both ends, as the oblong holes allow a large displacement while still leaving room for the bolts.

By designing the power current conductor to provide the deviation in width in the form of an incision a sufficiently strong locking together of the foils is achieved, and additionally it becomes possible to change already produced flexible power current conductors in order to make them function as desired according to the invention. If a reduction of the copper cross section is not desired, the deviation in width may simply be an increase in width.

The flexible power current conductor according to the invention may be provided with incisions in a simple way by designing them in the shape of a half circle.

If the flexible power current conductor according to the invention is designed with an equal number of incisions which are placed opposite each other, a secure, solid and uniform locking together of all the layers is achieved, and all displacements of the individual layers, when bent, will take place uniformly and in the longitudinal direction.

The flexible power curent conductor according to the invention is preferably designed with the encasing material being a thermo-shrinking insulating plastic material, as it is thereby achieved simultaneously that a part of the conductor is electrically insulated, that the foils are solidly connected to each other, and that the foils will be solidly locked together in the middle area, as the shrink film penetrates into the incisions and locks the foils together without reducing the flexibility of the conductor.

The invention will now be explained more detailed in the following in connection with a preferred embodiment and as shown in the drawing, in which.

Figure 1:
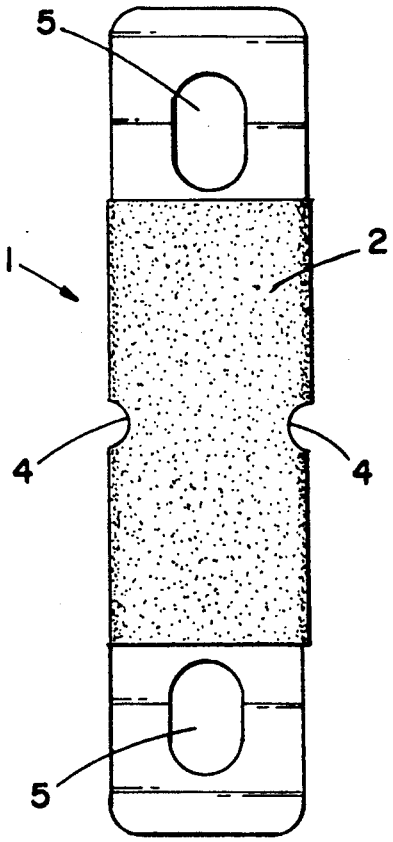
FIG. 1 shows the conductor perpendicularly to one of its widest sides.
Figure 2:
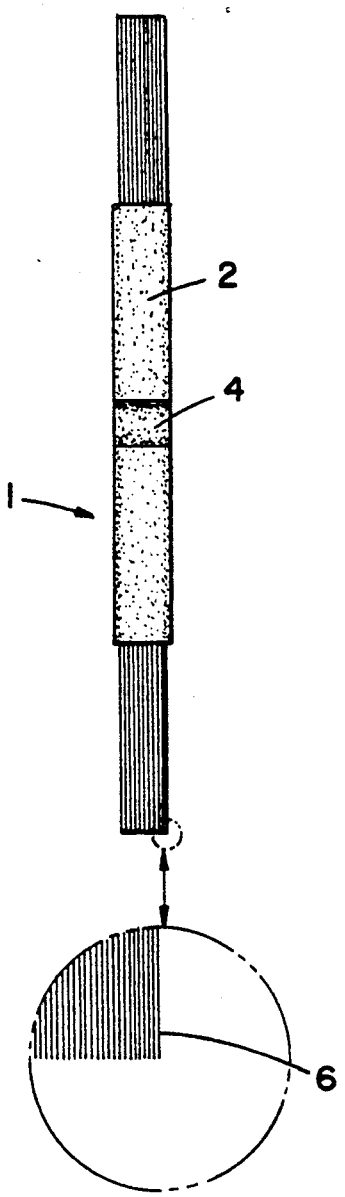
FIG. 2 is a side view of the conductor.

The conductor 1 is flexible because it consists of a large number of copper foils 6, cf. the segment shown in FIG. 2 in particular, which foils all have the same shape and size and normally the same thickness. The foil bundle which constitutes the conductor 1 has at each end an oblong hole 5 for a clamping bolt. Incisions 4, shaped as half circles, are provided at the middle of the conductor at each side and directly opposite each other. The main part of the conductor 1 is encased by thermo-shrinking film 2 of electrically insulating plastic. During the thermo-shrinking process the film penetrates into the incision 4 at each side and secures the conducting copper foils 6 in relation to each other.

In the embodiment shown the flexible conductor is 7.5 mm thick with a width of 36 mm and comprises 75 layers of copper foil, each with a thickness of 0.1 mm. The incisions 4 have a depth of approximately 3 mm, so that still the copper cross section is not reduced as much as at the bolt holes 5 at each end.

By this configuration the individual copper layers 6 can only be displaced in relation to each other in the directions extending outwards from the area of the incision 4. The displacement is thus distributed towards both ends of the conductor. The oblong holes 5 have a length of approximately double their width, so that the conductor may be bent at least 90° at each end.

The embodiment shown is only one example of the application of the invention. It will be obvious to someone skilled in the art that the invention may be employed in connection with any kind of flexible conductors comprising a number of thin conducting foils.

What is claimed is:

1. A flexible power current conductor (1) comprising a number of thin conducting foils (6) stacked one on top of the other with a uniform width, and with through-holes (5) for clamping bolts, characterized in that the conducting foils (6) are held together in a middle area by means of an encasing material (2) which encircles a part of the conducting foils, and that the conducting foils each have at least one point where the width deviates from the width of the rest of the foil, the points of the conducting foils being aligned with each other with the encasing material encasing the point of each conducting foil where the width deviates, and that the through-holes are (5) are located outside the encasing material and are oblong and extend in the longitudinal direction of the conductor.

2. A flexible power current conductor according to claim 1, characterized in that the deviation in width is in the form of an incision (4) in each conducting foil.

3. A flexible power current conductor according to claim 2, characterized in that the incision is shaped as a half circle.

4. A flexible power current conductor according to claim 2, characterized in that an equal number of incisions (4) are provided which are placed opposite each other.

5. A flexible power current conductor according to claim 1, characterized in that the encasing material (2) is a thermo-shrinking insulating plastic material.

* * * * *